US009932774B2

(12) United States Patent
Gillis

(10) Patent No.: US 9,932,774 B2
(45) Date of Patent: Apr. 3, 2018

(54) HYDRAULICALLY ACTUATED APPARATUS FOR GENERATING PRESSURE PULSES IN A DRILLING FLUID

(71) Applicant: Sean Gillis, Beaumont (CA)

(72) Inventor: Sean Gillis, Beaumont (CA)

(73) Assignee: DRILFORMANCE TECHNOLOGIES, LLC, Conro, TX (US)

( * ) Notice: Subject to any disclaimer, the term of this patent is extended or adjusted under 35 U.S.C. 154(b) by 138 days.

(21) Appl. No.: 15/209,377

(22) Filed: Jul. 13, 2016

(65) Prior Publication Data

US 2017/0016289 A1 Jan. 19, 2017

Related U.S. Application Data

(60) Provisional application No. 62/193,490, filed on Jul. 16, 2015.

(51) Int. Cl.

| | |
|---|---|
| ***E21B 21/10*** | (2006.01) |
| ***E21B 7/24*** | (2006.01) |
| ***E21B 4/10*** | (2006.01) |

(52) U.S. Cl.

CPC . *E21B 7/24* (2013.01); *E21B 4/10* (2013.01)

(58) Field of Classification Search

CPC ..... E21B 4/10; E21B 4/14; E21B 21/10

See application file for complete search history.

(56) References Cited

U.S. PATENT DOCUMENTS

| | | | | |
|---|---|---|---|---|
| 3,958,217 | A | 5/1976 | Spinnler | |
| 5,040,155 | A | 8/1991 | Feld | |
| 6,009,948 | A | 1/2000 | Flanders et al. | |
| 6,053,261 | A | 4/2000 | Walter | |
| 6,279,670 | B1 | 8/2001 | Eddison et al. | |
| 6,484,817 | B2 | 11/2002 | Innes | |
| 6,508,317 | B2 | 1/2003 | Eddison et al. | |
| 6,586,515 | B1 | 7/2003 | Eddison | |
| 8,167,051 | B2 * | 5/2012 | Eddison | E21B 21/103 166/177.7 |
| 2006/0243487 | A1 * | 11/2006 | Turner | E21B 7/062 175/26 |
| 2008/0029268 | A1 * | 2/2008 | Macfarlane | E21B 10/60 166/311 |
| 2008/0060846 | A1 * | 3/2008 | Belcher | E21B 17/042 175/25 |
| 2012/0048619 | A1 | 3/2012 | Seutter et al. | |

(Continued)

*Primary Examiner* — Shane Bomar

(74) *Attorney, Agent, or Firm* — Kirsten M. Oates; Rodman & Rodman LLP

(57) ABSTRACT

An apparatus for generating pressure pulses in a drilling fluid flowing through a bore of a downhole tubular. A housing containing a rotor is located in the bore. Drilling fluid flowing through the housing actuates rotation of the rotor relative to the housing, which in turn drives movement of an actuator valve assembly to vary flow of drilling fluid between the bore and an actuator chamber defined by the actuator valve assembly and the housing. The resulting variation in drilling fluid pressure within the actuator chamber actuates a pulse valve assembly to vary flow of drilling fluid through the housing and into the bore. The varying drilling fluid pressure may be used to induce a percussive effect in a drill bit assembly coupled to the downhole tubular.

20 Claims, 8 Drawing Sheets

(56) References Cited

U.S. PATENT DOCUMENTS

| | | | | |
|---|---|---|---|---|
| 2012/0103594 | A1* | 5/2012 | Hall | E21B 34/06<br>166/194 |
| 2015/0315846 | A1* | 11/2015 | Tulloch | C09J 183/04<br>175/57 |
| 2015/0377018 | A1* | 12/2015 | Lee | E21B 47/182<br>340/854.3 |

* cited by examiner

HYDRAULICALLY ACTUATED APPARATUS FOR GENERATING PRESSURE PULSES IN A DRILLING FLUID

TECHNICAL FIELD

The invention relates to downhole apparatuses for generating pressure pulses in a drilling fluid flowing through a downhole tubular, and more particularly to such an apparatus as may be used to induce a percussive effect in a drill bit.

BACKGROUND OF THE INVENTION

Drilling of a wellbore may be enhanced by generating pressure pulses in a drilling fluid flowing through a drill string as the wellbore is being drilled. The pressure pulses may vibrate the drill string to reduce frictional forces between the drill string and the wellbore, and may induce a percussive effect at the drill bit to help advance the drill string through the wellbore.

The following prior art references disclose a variety of downhole apparatuses for generating pressure pulses in a drilling fluid flowing through a drill string: U.S. Pat. No. 3,958,217 (Spinnler); U.S. Pat. No. 5,040,155 (Feld); U.S. Pat. No. 6,053,261 (Walter); U.S. Pat. No. 6,484,817 (Innes); U.S. Pat. No. 6,508,317 (Eddison et al.); U.S. Patent Application Publication No. 2012/0048619 (Seutter et al.); and U.S. Patent Application Publication No. 2012/160,476 (Bakken).

In particular, U.S. Pat. No. 3,958,217 (Spinnler) discloses a mud pulse telemetry system for transmitting information from the bottom of a well hole to the surface. The mud pulse telemeter includes a pulsing valve operated by a pilot valve mechanism, which is in turn controlled by electrical input power. U.S. Pat. No. 5,040,155 (Feld) discloses a double guided mud pulse valve that includes a main valve body and an auxiliary valve. To produce a pressure pulse in a drilling medium, the auxiliary valve is controlled by a device for determining drilling measurement data. U.S. Pat. No. 6,508,317 (Eddison et al.) discloses a downhole flow pulsing apparatus that includes a valve located in the throughbore of a housing. A fluid actuated positive displacement motor is associated with a movable valve member to vary the area of the valve's flow passage, and provide a varying fluid flow therethrough. The apparatus may be provided in combination with a drill bit and a pressure responsive device that expands or retracts in response to the varying drilling pressure created by the varying flow passage area, to provide a percussive effect at the drill bit.

There remains a need for a downhole apparatus for generating pressure pulses in a drilling fluid flowing through a drill string, and more particularly such an apparatus that is suitable for inducing a percussive effect at a drill bit.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

References in this document to "proximal" means located relatively toward an intended "uphole" end, "upper" end and/or "surface" end of a wellbore or of an apparatus or downhole tubular positioned in a wellbore.

References in this document to "distal" means located relatively away from an intended "uphole" end, "upper" end and/or "surface" end of a wellbore or of an apparatus or downhole tubular positioned in a wellbore.

References in this document to "downhole tubular" may be used to describe any equipment or tool or component thereof, which may be inserted into a wellbore, and which has a tubular configuration that defines an internal bore. A non-limiting example of a downhole tubular is a section or joint of a drill string.

References in this document to "coupled" in describing the relationship between two parts means that the two parts are attached either indirectly or directly to each other, and includes the two parts being integral with each other.

In one aspect, the present invention is directed to an apparatus for use with a downhole tubular defining a bore for conveying a drilling fluid between a proximal end and a distal end. In an exemplary use, the apparatus may be used to generate pressure pulses in the drilling fluid. In another exemplary use, the apparatus may be used to induce a percussive effect at a drill bit.

In general, the apparatus comprises a housing, a rotor, an actuator valve assembly comprising an actuator valve stationary member and an actuator valve moving member, and a pulse valve assembly comprising a pulse valve stationary member and a pulse valve moving member. In embodiments, the apparatus may further comprise a downhole tubular section, a retainer for retaining the housing within the downhole tubular section, and/or a drill bit assembly.

In embodiments, the downhole tubular section defines a portion of the bore of the downhole tubular, and may allow the apparatus to be removably attached to other adjacent tubular sections. In embodiments, the downhole tubular section may comprise a plurality of subsections that are removably attached to each other. In embodiments, the downhole tubular section may be adapted to attach to the adjacent tubular sections in the downhole tubular with any suitable means known in the art including, without limitation, threaded pin-type or box-type end connections.

The housing of the apparatus contains the rotor, the actuator valve assembly, and the pulse valve assembly. The housing is shaped and sized for location in the bore of the downhole tubular. In embodiments, the housing may have a substantially cylindrical shape with an external diameter that is less than an internal diameter of the downhole tubular. In embodiments, the housing may be removably insertable in the downhole tubular. In embodiments, the housing may either have an attached retrieval spear, or may define a neck for engagement by a downhole retrieval tool, to facilitate retrieval of the apparatus from the downhole tubular using downhole tools.

The housing internally defines a power flow path, an actuator flow path, and a pulse flow path. The power flow path extends from a power flow path inlet to a power flow path outlet. The actuator flow path extends from an actuator flow path inlet to an actuator flow path outlet. The pulse flow path extends from a pulse flow path inlet to a pulse flow path outlet. Each of the aforementioned flow paths, flow path inlets, and flow path outlets are in drilling fluid communication with the bore of the downhole tubular when the housing is inserted the bore.

In embodiments, the housing may define a different aperture for each of the aforementioned flow path inlets and flow path outlets. In embodiments, the housing may define a single first aperture that defines both the power flow path inlet, and the actuator flow path inlet. In embodiments, the housing may define a single second aperture that defines both the power flow path outlet and the actuator flow path outlet. It will be understood that the power flow path, the actuator flow path and the pulse flow path may be combined in part or whole, and may be in fluid communication with each other internally within the housing, externally via the portion of the bore defined by the downhole tubular, or a combination of both. In embodiments, the power flow path and the actuator flow path are coextensive with each other.

In embodiments, the pulse flow path outlet may be distal to the power flow path outlet and the actuator flow path outlet. In embodiments, the pulse flow path outlet may be proximal to the actuator flow path outlet and the power flow path outlet. In embodiments, the pulse valve assembly is distal to the actuator valve assembly, while in embodiments, the pulse valve assembly is proximal to the actuator valve assembly.

The rotor may be any type of rotor the rotation of which is actuated by the hydraulic power of the drilling fluid flowing through the power flow path to rotate relative to the housing. In some embodiments, the rotor may be a part of a positive displacement motor comprising a stator and a rotor, such as a positive displacement motor operating in accordance with the Moineau principle. In embodiments, the stator may be formed by an internal wall of the housing. In other embodiments, the rotor may comprise a helical rotor, a turbine rotor, or a toroidal rotor, or other motors having lobes or vanes configured to induce rotation of the rotor in response to the hydraulic power of the drilling fluid flowing through the power flow path.

The actuator valve assembly and housing collectively define an actuator chamber that is internal to the housing and in drilling fluid communication with the bore via the actuator flow path inlet. In embodiments, the actuator chamber may be distal to the actuator flow path inlet and the actuator flow path outlet. In embodiments, the actuator chamber may be distal to the actuator flow path inlet, and proximal to the actuator flow path outlet.

The actuator valve assembly regulates the flow of the drilling fluid from the actuator chamber to the actuator flow path outlet. The actuator valve stationary member defines an actuator valve passage for drilling fluid communication from the actuator chamber to the bore via the actuator flow path outlet. In embodiments, the actuator valve stationary member may be integral with the housing. In embodiments, the actuator valve assembly may also regulate the flow of drilling fluid from the actuator flow path inlet to the actuator chamber, and the actuator valve passage may also allow for drilling fluid communication from the actuator flow path inlet to the actuator flow path. In embodiments, the actuator valve passage may be defined by an aperture formed in the actuator valve stationary member. In other embodiments, the actuator valve passage may be defined by a channel formed between an exterior surface of the actuator valve stationary member and an inner wall of the housing.

The rotor is in driving engagement with the actuator valve moving member. As used in this document, "driving engagement" means that the rotor is coupled (either directly or indirectly) to the actuator valve moving member such that movement of the rotor drives movement of the actuator valve moving member. In turn, movement of the actuator valve moving member varies an open area of the actuator valve passage between a minimum actuator valve open area and a maximum actuator valve open area, and thereby creates a variation of drilling fluid pressure in the actuator chamber as drilling fluid flows through the actuator flow path. As used in this document, "vary an open area of the actuator valve passage" and like expressions mean that the actuator valve moving member moves to change the cross-sectional flow area of the actuator valve passage that is blocked by the actuator valve moving member. Accordingly, in embodiments, the actuator valve moving member may "vary an open area of the actuator valve passage" by member moving from a first position in which it blocks none or a lesser part of the cross-sectional flow area of the actuator valve passage, to a second position in which blocks a greater part or a whole of the cross-sectional flow area of the actuator valve passage.

In embodiments, the rotor is coupled directly to the actuator valve moving member so that the actuator valve moving member varies the open area of the actuator valve passage by rotating relative to the actuator valve passage so as to periodically occlude or expose the open area of the actuator valve passage or a portion thereof. In embodiments, the actuator valve moving member may vary the open area of the actuator valve passage by rotating relative to the actuator valve passage so as to periodically align an actuator valve moving member passage with the open area of the actuator valve passage or a portion thereof.

In other embodiments, the rotor is coupled indirectly to the actuator valve moving member so that the actuator valve moving member varies the open area of the actuator valve passage by motions other than rotation relative to the actuator valve passage. For example, the movement of the actuator valve moving member to vary the open area of the actuator valve passage may be pivotal, translational or a combination of pivotal or translational relative to the actuator valve stationary member. The rotor may be coupled indirectly to the actuator valve moving member by a drive mechanism, such as a cam, to transform rotation of the rotor into the pivotal and/or translational movement of the actuator valve moving member.

The pulse valve assembly regulates the flow of the drilling fluid in the pulse flow path. The pulse valve stationary member defines a pulse valve passage for drilling fluid communication from the pulse flow path inlet to the pulse flow path outlet.

In embodiments, the pulse valve passage may be defined by an aperture formed in the pulse valve stationary member. In embodiments, the pulse valve passage may be defined by a channel formed between an exterior surface of the pulse valve stationary member and an inner wall of the housing.

The pulse valve moving member is exposed to the actuator chamber so that, in use, it moves in response to varying drilling fluid pressure in the actuator chamber to vary an open area of the pulse valve passage between a minimum pulse valve open area and a maximum pulse valve open area. As used in this document, "vary an open area of the pulse valve passage" and like expressions mean that the pulse valve moving member moves to change the cross-sectional flow area of the pulse valve passage that is blocked by the pulse valve moving member. In embodiments, the pulse valve moving member may "vary an open area of the pulse valve passage" by moving from a first position in which it blocks none or a lesser part of the cross-sectional flow area of the pulse valve passage, to a second position in which it blocks a greater part or a whole of the cross-sectional flow area of the pulse valve passage.

The pulse valve moving member may be any type of valve member that moves in response to the variation of drilling fluid pressure in the actuator chamber. In embodiments, the pulse valve moving member may be a ball, a hinged flap, a diaphragm, a piston, a poppet, or a shuttle.

In embodiments, the pulse valve stationary member may define a pulse valve seat, and the pulse valve moving may vary the open area of the pulse valve passage by moving to alternately engage with and disengage from the valve seat.

In embodiments, the pulse valve moving member may vary the open area of the pulse valve passage by moving to alternately extend into and withdraw from the pulse valve passage.

In embodiments, the pulse valve moving member may define a pulse valve moving member passage. In embodiments, the pulse valve moving member passage may be for drilling fluid communication from the actuator chamber to the pulse flow path. In embodiments, the pulse valve moving member passage may be for drilling fluid communication from the actuator flow path inlet to the actuator chamber.

In embodiments, the pulse valve assembly may further comprise a spring that biases the pulse valve moving member towards a position in which the open area of the pulse valve passage is either at the minimum pulse valve open area or at the maximum pulse valve open area. In embodiments, the spring may comprise any suitable type of spring known in the art including, without limitation, a coil spring.

In embodiments, the pulse valve passage may be shaped to, in use, accelerate flow of drilling fluid in the pulse flow path and thereby generate a reduced pressure of drilling fluid to urge the pulse valve moving member towards a position in which the open area of the pulse valve passage is at either the minimum pulse valve open area or the maximum pulse valve open area.

The retainer engages the downhole tubular and the housing, either permanently or removably, within the bore for limiting movement of the housing relative to the downhole tubular. The retainer may comprise any suitable device known in the art for limiting vertical and rotational movement of the housing within the downhole tubular section. In embodiments, the retainer may comprise an annular member that circumferentially surrounds the housing and is disposed in an annular space between the housing and an inner wall of the downhole tubular section.

In embodiments, the retainer may define a retainer passage allowing for drilling fluid communication from a proximal end of the retainer to a distal end of the retainer. In embodiments, the retainer passage may be defined by an aperture formed in the retainer. In embodiments, the retainer passage may be defined by a channel formed between an exterior surface of the retainer and an inner wall of the housing. In embodiments, the retainer passage may be shaped to accelerate the flow of drilling fluid as it flows through the retainer passage. In embodiments, the retainer passage allows for drilling fluid to flow through the bore and bypass the pulse flow path.

In embodiments, the apparatus may further comprise a restrictor disposed in the annular space between the housing and an inner wall of the downhole tubular, wherein the restrictor is positioned to limit drilling fluid communication via the bore between the pulse flow path inlet and the pulse flow path outlet.

In embodiments, the apparatus may further comprise a drill bit assembly. In embodiments, the drill bit assembly comprises a drill bit body comprising a first drill bit body portion, a second drill bit body portion, and a drill bit spring. In embodiments, the first drill bit body portion comprises a tubular outer drill bit body, and the second drill bit body portion comprises an inner drill bit body disposed within the outer drill bit body. The first drill bit body portion is coupled to the downhole tubular. The second drill bit body portion comprises a cutting element for cutting a wellbore, and moves relative to the second drill bit body portion between a proximal retracted position and a distal extended position in response to the varying fluid pressure at the pulse flow path outlet. In embodiments, the second drill bit body portion defines a drill bit bore for drilling fluid communication from the pulse flow path outlet to the wellbore. The drill bit spring biases the inner drill bit body toward either the proximal retracted position or the distal extended position.

In another aspect, the present invention is directed to a method that comprises the steps of:

(a) providing an apparatus in a bore of a downhole tubular, wherein the apparatus comprises:
  (i) a housing that defines at least one flow path for drilling fluid in drilling fluid communication with the bore;
  (ii) a fluid actuated positive displacement motor comprising a rotor internal to the housing that rotates relative to the housing in response to drilling fluid flowing through the at least one flow path;
  (iii) an actuator valve assembly internal to the housing, wherein the actuator valve assembly and the housing collectively define an actuator chamber internal to the housing and in drilling fluid communication with the at least one flow path, wherein the actuator valve assembly comprises an actuator valve stationary member defining an actuator valve passage for drilling fluid communication from the actuator chamber to the at least one flow path, and an actuator valve moving member internal to the housing; and
  (iv) a pulse valve assembly comprising a pulse valve stationary member defining a pulse valve passage for drilling fluid communication from the at least one flow path to the bore, and a pulse valve moving member; and (b) flowing the drilling fluid through the at least one flow path to actuate rotation of the rotor, wherein the rotor is in driving engagement with the actuator valve moving member to drive movement of the actuator valve moving member to vary an open area of the actuator valve passage and thereby vary drilling fluid pressure in the actuator chamber, wherein varying drilling fluid pressure in the actuator chamber actuates the pulse valve moving member to move relative to the pulse valve stationary member and thereby vary an open area of the pulse valve passage and effect a varying fluid pressure in the at least one flow path and the bore.

In embodiments, the method further comprises the step of providing a drill bit assembly comprising: a first drill bit body portion coupled to the downhole tubular; a second drill bit body portion comprising a cutting element for cutting a wellbore, the second drill bit body portion movable relative to the first drill bit body portion between a proximal retracted position and a distal extended position in response to varying fluid pressure in the at least one flow path; and a drill bit spring that biases the inner drill bit body towards either the proximal retracted position or the distal extended position.

BRIEF DESCRIPTION OF DRAWINGS

In the drawings, like elements are assigned like reference numerals. The drawings are not necessarily to scale, with the emphasis instead placed upon the principles of the present invention. The drawings depict exemplary embodiments of the present invention, which are only one of a number of possible arrangements utilizing the fundamental concepts of the present invention. The drawings are briefly described as follows.

DETAILED DESCRIPTION

Exemplary embodiments of the apparatus of the present invention are now described in uses with a downhole tubular in the form of a drill string. It will be understood, however, that the present invention may be implemented with downhole tubulars of types other than a drill string.

First Exemplary Embodiment

Figure 1:
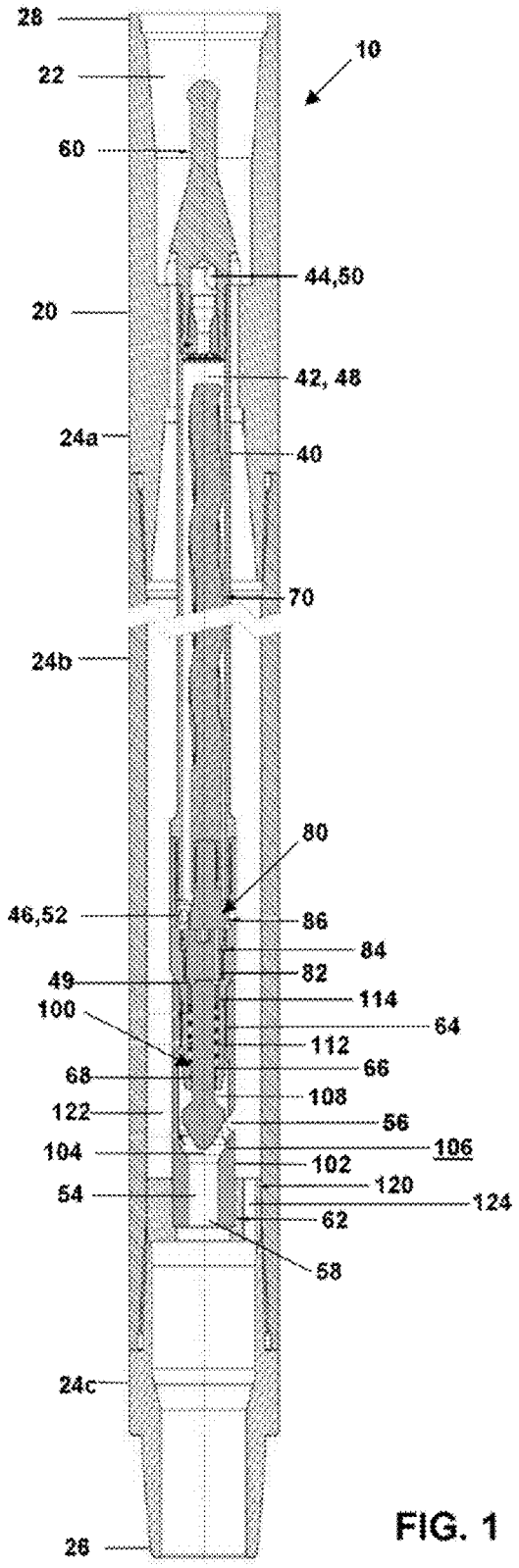
FIG. 1 is a longitudinal cross-sectional view of a first exemplary embodiment of the apparatus of the present invention, with the pulse valve moving member in the open position.

FIG. 1 shows an exemplary embodiment of the apparatus (10) of the present invention in use with a downhole tubular in the form of a drill string tubular (20). In general, the apparatus (10) comprises a housing (40), a rotor (70), an actuator valve assembly (80) comprising an actuator valve stationary member (82) and an actuator valve moving member (86), a pulse valve assembly (100) comprising a pulse valve stationary member (102) and pulse valve moving member (108), and a retainer (120). It will be understood that the parts of the apparatus may be made of any material that is suitable for use in a downhole environment, including without limitation, alloy steels.

The drill string tubular (20) allows the apparatus (10) to be attached to adjacent drill string tubulars in the drill string and defines a portion of the drill string bore (22). In this exemplary embodiment, the drill string tubular (20) is formed from three sections (24*a*), (24*b*), (24*c*) that are connected together with threaded end connections. A threaded pin-type connection is provided at the distal end (26) of the drill string tubular (20), and a threaded box-type connection is provided at the proximal end (28) of the drill string tubular (20). Accordingly, the drill string tubular (20) may be attached to adjacent drill string tubulars in the drill string such that the portion of the drill string bore (22) is in drilling fluid communication with the adjacent portions of the drill string bore.

The housing (40) contains the rotor (70), the actuator valve assembly (80), and the pulse valve assembly (100). In this exemplary embodiment, the housing (40) is a substantially cylindrical tubular body having an outer diameter less than the inner diameter of the drill string tubular (20) so as to be insertable therein, and may be made sufficiently small so as to facilitate the use of downhole tools for retrieving the housing (40) from the drill string tubular (20) without having to run the drill string tubular (20) out of the wellbore.

In the exemplary embodiment, the proximal end of the housing (40) has an integrally formed retrieval spear (60) to facilitate removal of the housing (40) from the drill string tubular (20) using downhole tools. The distal end of the housing (40) has an integrally formed venturi housing (62) that forms a seat (106) of the pulse valve stationary member (102), as further described below.

The housing (40) internally defines a power flow path (42) extending from a power flow path inlet (44) to a power flow path outlet (46), an actuator flow path (48) extending from an actuator flow path inlet (50) to an actuator flow path outlet (52), and a pulse flow path (54) extending from a pulse flow path inlet (56) to a pulse flow path outlet (58). As can be seen in FIG. 1, each of the aforementioned flow paths, and their respective inlets and outlets are in drilling fluid communication with the drill string bore (22) when inserted therein. In this exemplary embodiment, a single first aperture of the housing (40) defines both the power flow path inlet (44) and the actuator flow path inlet (50), and a single second aperture of the housing (40) defines both the power flow path outlet (46) and the actuator flow path outlet (52), such that the power flow path (42) and the actuator flow path (48) are coextensive with each other.

The rotor (70) rotates relative to the housing (40) in response to drilling fluid flowing through the power flow path (42). In this exemplary embodiment, the rotor (70) is part of a positive displacement motor that operates in accordance with the Moineau principle. The rotor (70) has a number of lobes that differs from the number of lobes of a stator formed by the inner wall of the section of the housing (40) that surrounds the rotor (70), so as to collectively form the positive displacement motor. Accordingly, flow of drilling fluid through this section of the housing (40) will cause the rotor (40) to rotate eccentrically within the housing (40). Use of such a rotor avoids the need for electrical motors, solenoids, batteries, or other electronic components which may be prone to failure in the wellbore.

The actuator valve assembly (80) and the housing (40) collectively define an actuator chamber (49) internal to the housing (40) and in drilling fluid communication with the actuator flow path (48). In this exemplary embodiment, the actuator chamber (49) is distal to the actuator flow path inlet (50), and the actuator flow path outlet (52).

The actuator valve assembly (80) regulates the flow of the drilling fluid from the actuator chamber (49) to the actuator flow path outlet (52). In this exemplary embodiment, the actuator valve assembly (80) also regulates the flow of drilling fluid from the actuator flow path inlet (50) to the actuator chamber (49). The actuator valve stationary member (82) is disposed in the housing (40) and defines an actuator valve passage (84) for drilling fluid communication between the actuator chamber (49) and the actuator flow path (48). In this exemplary embodiment, the actuator valve stationary member (82) comprises a cylindrical member that fits sealingly within the internal wall of the housing (40), and prevents flow of the drilling fluid through the housing (40) except through the actuator valve passage (84). In this exemplary embodiment, the actuator valve passage (84) is provided in the form of an aperture extending through the actuator valve stationary member (82) from a proximal end to a distal end. In this exemplary embodiment, the actuator valve moving member (86) comprises a cylindrical member having an outer diameter smaller than the inner diameter of the housing (40), and is attached directly to the distal end of the Moineau-type rotor (70). The axis of the rotor (70) and the attached actuator valve moving member (86) are eccentric to the axis of the actuator valve stationary member (82). Accordingly, as the rotor (70) rotates, the attached actuator valve moving member (86) moves to periodically occlude and reveal the actuator valve passage (84) so as to prevent or permit drilling fluid communication between the actuator chamber (49) and the actuator flow path (48). (The position of the actuator valve moving member (86) in an open and closed position may be seen in FIGS. 4 and 5, respectively, which shows a second embodiment of the apparatus of the invention, as described below, having the same actuator valve assembly (80) as the apparatus (10) shown in FIG. 1.)

The pulse valve assembly (100) regulates the flow of the drilling fluid in the pulse flow path (54). In this exemplary embodiment, the aforementioned venturi housing (62) defines a pulse valve passage (104) for drilling fluid communication from the pulse flow path inlet (56) to the pulse flow path outlet (58), and a seat (106). The pulse valve passage (104) is provided in the form of an aperture shaped to accelerate the drilling fluid flowing from the pulse valve inlet (56) to the pulse valve outlet (58). The pulse valve moving member (108) is a poppet that comprises a stem having a proximal end that is received within an inner sleeve (64) of the housing (40) and exposed to the actuator chamber (49), and a distal end that terminates in a tapered plug disposed outside the inner sleeve (64). An annular sealing element (68) attached to the inner sleeve (64) engages the stem of the pulse valve moving member (108). Accordingly, the actuator chamber (49) is sealed when the actuator passage (84) is completely occluded by the actuator valve moving member (86).

The spring (112) biases the pulse valve moving member (108) towards either the closed position or the open position. In this exemplary embodiment, the spring (112) is provided in the form of a coil spring disposed around the stem of the pulse valve moving member (108). The spring (112) is compressed between an upper shoulder (114) formed externally on the proximal end of the stem, and a lower shoulder (66) formed internally on the distal end of the inner sleeve (64). The upper shoulder (114) has an outer diameter that fits within a close tolerance of the inner diameter of the inner sleeve (64) so as to behave like a piston within the inner sleeve (64).

In the exemplary embodiment, the retainer (120) engages the housing (40) and the inner wall of the portion of the drill string bore (22) defined by the drill string tubular (20). In the exemplary embodiment, the retainer (120) limits both rotational movement and translational movement of the housing (40) relative to the drill string tubular (20) so that the rotor (70) rotates within the housing (40) despite the reactive torque and forces induced by movement of the rotor (70). In this exemplary embodiment, the retainer (120) comprises an annular member that circumferentially surrounds the housing (40) and is disposed in an annular space (122) between the housing (40) and an inner wall of the drill string tubular (20). The retainer (120) defines a retainer member passage (124) in the form of an aperture allowing for drilling fluid communication from a proximal end of the retainer (120) to a distal end of the retainer (120).

Figure 2:
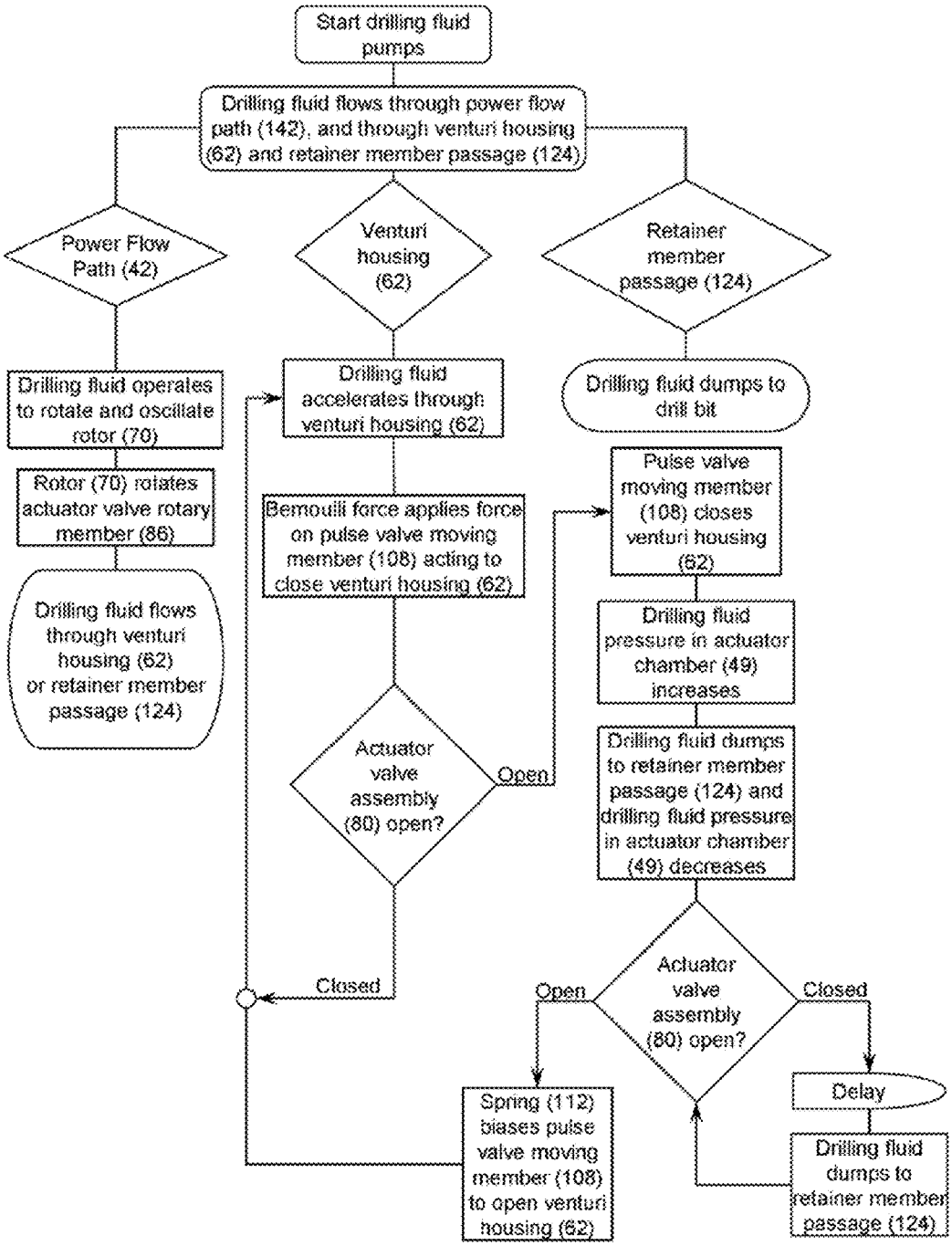
FIG. 2 is a flow chart showing one embodiment of the operation of the exemplary embodiment of the apparatus shown in FIG. 1.

The use and operation of this exemplary embodiment of the apparatus (10) is described with reference to FIG. 2.

The housing (40) and the components of the apparatus (10) contained therein are fixed in the downhole tubular (20) by retaining member (120), and engagement of the distal shoulder of retrieval spear (60) with an internal shoulder of the drill string tubular (20). The drill string is "made up" to include the drill string tubular (20) by connecting a threaded pin-type connection at the distal end (26) to a distal adjacent drill string tubular (not shown), and by connecting a threaded box-type connection at the proximal end (28) to a proximal adjacent drill string tubular (not shown). The drill string tubular (20) containing the housing (40) and the components of the apparatus (10) contained therein are run into the wellbore. Alternatively, the housing (40) and the components of the apparatus (10) contained therein may be landed on the retaining member (120) after the drill string tubular (20) is run into the wellbore. When it is desired to remove the apparatus (10) from the drill string, a downhole tool may be attached to the retrieval spear (60) to pull the housing (40) and the components contained therein out of the drill string tubular (20), without running the drill string tubular (20) out of the wellbore. A drill bit assembly (not shown) may be coupled to distal end of the downhole tubular (20).

With the apparatus (10) so installed, drilling fluid pumps are started to convey drilling fluid under pressure to the apparatus (10). Drilling fluid flows downwardly in the annular space between the inner wall of the downhole tubular (20) and the outer wall of the housing (40). When the pulse valve moving member (108) is in the open position as shown in FIG. 1, the drilling fluid flows into the housing (40) via the pulse flow path inlet (56), through the pulse flow path (54), and out of the housing (40) via the pulse flow path outlet (58). The shape of the pulse valve passage (104) accelerates the drilling fluid as it flows towards the pulse flow path outlet (58). In accordance with the Bernoulli Effect, this creates a region of low drilling fluid pressure in the region immediately distal to the tapered head of the pulse valve moving member (108). This urges the pulse valve moving member (108) against the biasing effect of the spring (112) and into engagement with the seat (106).

When the pulse valve moving member (108) is in a closed position, the pulse valve moving member (108) engages the seat (106) to prevent drilling fluid flowing through the pulse flow path outlet (58). Accordingly, the drilling fluid will instead flow through the retainer passage (124), thus bypassing the pulse flow path (54). Moreover, the Bernoulli Effect will be interrupted, and the spring (112) will have been extended so as to result in a restoring force that tends to bias the pulse valve moving member (108) back towards the open position.

The phase of the actuator valve assembly (80) governs whether or not the pulse valve moving member (108) is able to move between the open position and the closed position, as described above, and hence whether the drilling fluid flows through the venturi housing (62), or flows through the retainer member passage (124) and is "dumped" to the drill bit. The drilling fluid flows into the aperture that defines power flow path inlet (44). As the drilling fluid flows past the rotor (70), the drilling fluid actuates rotation of the Moineau-type rotor (70), which in turn drives actuator valve moving member (86) to rotate eccentrically relative to the actuator valve stationary member (82), and thereby periodically occlude the actuator valve passage (84).

When the actuator valve moving member (86) completely occludes the actuator valve passage (84), the drilling fluid cannot flow into or out of the actuator chamber (49). This creates a hydrostatic lock preventing movement of the pulse valve moving member (108). Conversely, when the actuator valve moving member (86) does not completely occlude the actuator valve passage (84), the drilling fluid can flow between the actuator flow path (48) and the actuator chamber (49). If the pulse valve moving member (108) is in the closed position, the drilling fluid will tend to flow from the actuator chamber (49) to the actuator flow path (48) as the spring (112) biases the pulse valve moving member (108) back towards the open position. If the pulse valve moving member (108) is in the open position, then drilling fluid will tend to flow from the actuator flow path (48) into the actuator chamber (49) as the Bernoulli Effect biases the pulse valve moving member (108) towards the closed position.

In other words, the periodic opening and closing of the actuator stationary member passage (84) varies the pressure of drilling fluid in the actuator chamber (49) acting on the proximal end of the pulse valve moving member (108), and thus the resultant force acting on the pulse valve moving member (108) due to the drilling fluid pressure in the actuator chamber (49), the restoring force of the spring (112), and the Bernoulli Effect of the drilling fluid flowing through the pulse valve passage (104). The pulse valve moving member (108) moves upwards to the open position when the resultant force acts upwards, and moves downwards to the closed position when the resultant force acts downwards. As drilling fluid flows continues to flow through the power flow path (42), the rotor (70) continues to rotate the actuator valve moving member (86), so as to cause the periodic opening and closing of the pulse valve assembly (100). By controlling the opening and closing of the pulse valve assembly (100) in this way, frequency control and amplitude of a pressure pulse of drilling fluid flowing through the pulse flow path outlet (58) may be established with very little energy input from an actuator valve assembly (80). Thus, the actuator valve assembly (80) functions as a pilot valve for the pulse valve assembly (100).

Second Exemplary Embodiment

Figure 3:
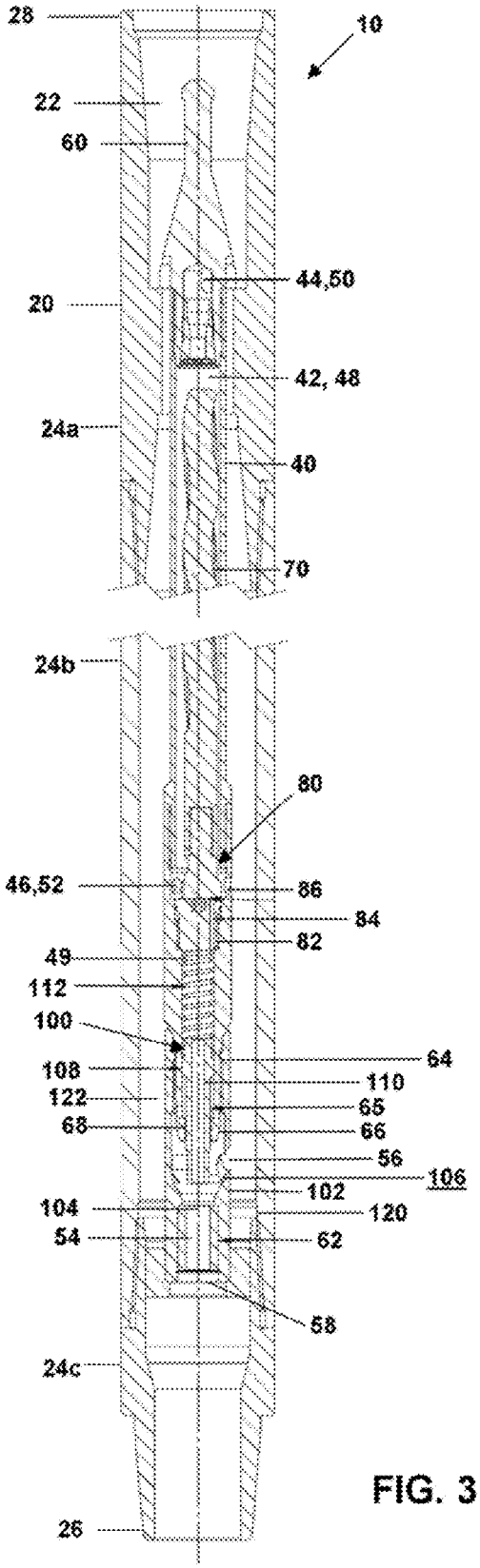
FIG. 3 is a longitudinal cross-sectional view of a second exemplary embodiment of the apparatus of the present invention, with the pulse valve moving member in the open position.
Figure 4:
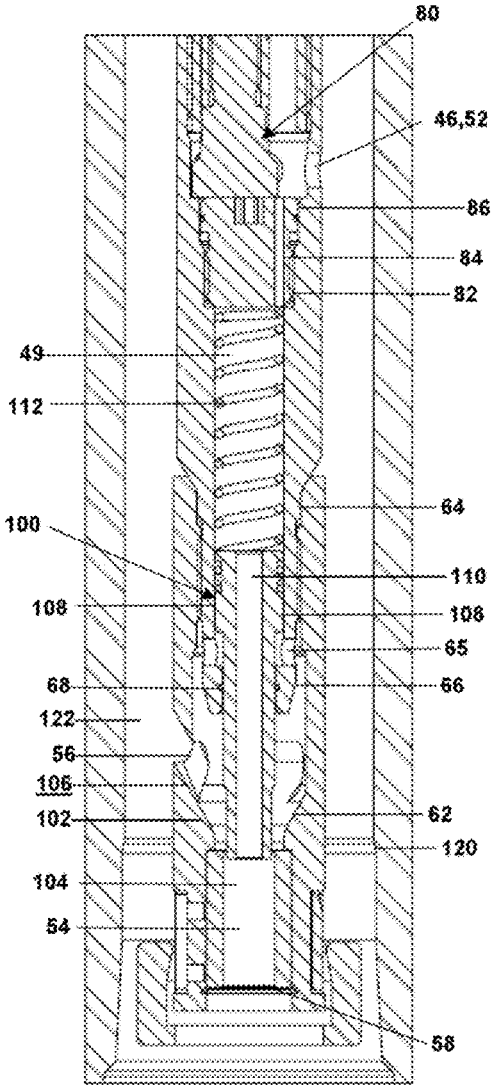
FIG. 4 is an enlarged view of the actuator valve assembly and the pulse valve assembly in the embodiment of the apparatus shown in FIG. 3, with the actuator valve moving member in the open position and the pulse valve moving member in the closed position.
Figure 5:
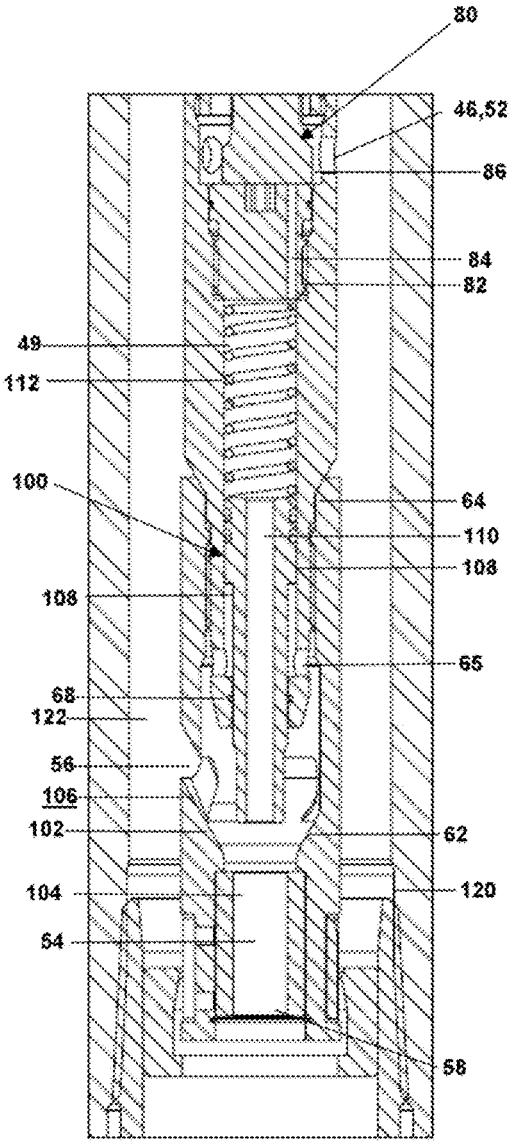
FIG. 5 is an enlarged view of the actuator valve assembly and the pulse valve assembly in the embodiment of the apparatus shown in FIG. 4, with the actuator valve moving member in the closed position and the pulse valve moving member in the open position.

FIGS. 3-5 show another exemplary embodiment of the apparatus (10) of the present invention. In FIGS. 3-5, parts that correspond to parts in FIG. 1 are assigned the same reference numerals. The differences between the apparatus (10) of FIG. 3 and that of FIG. 1 are described below.

In this exemplary embodiment, the pulse valve moving member (108) comprises a substantially cylindrical tubular shaft that inserts into the pulse valve passage (104) to completely close the open area of the pulse valve passage (104), and withdraws from the pulse valve passage (104) to completely open the open area of the pulse valve passage (104). The pulse valve moving member (108) defines a pulse valve moving member passage (110) for drilling fluid communication between the actuator chamber (49), and the pulse flow path (54).

The proximal end of the coil spring (112) bears upwardly against the distal end of the actuator valve stationary member (82). The distal end of the spring (112) engages circumferential grooves formed in the proximal end of the pulse valve moving member (108), and bears downwardly on the proximal end of the pulse valve moving member (108). Accordingly, upward movement of the pulse valve moving member (108) compresses the spring (112), which biases the pulse valve moving member (108) downwards. Conversely, downward movement of the pulse valve moving member (108) extends the spring (112), which biases the pulse valve moving member (108) upwards. Between the proximal end of the pulse valve moving member (108) and the annular sealing element (68), the inner sleeve (64) defines an inner sleeve aperture (65) for drilling fluid to flow between the interior of the inner sleeve (64) and the interior of the housing (40), thus allowing for movement of the pulse valve moving member (108) despite its sealing engagement with the interior of the inner sleeve (64) above and below the inner sleeve aperture (65).

The proximal end of the pulse valve moving member (108) fits within a close tolerance of the inner diameter of the inner sleeve (64) so as to behave like a piston within the inner sleeve (64).

The retainer (120) does not have any retainer passages (124), and as such, any drilling fluid flowing past the apparatus (10), must flow through the pulse flow path (54).

The use and operation of this exemplary embodiment of the apparatus (10) shown in FIG. 3 is similar to the use and operation of the exemplary embodiment of the apparatus (10) shown in FIG. 1, with the differences described below.

When the distal end of the pulse valve moving member (108) is withdrawn from the pulse valve passage (104) as shown in FIG. 3, the pulse valve moving member (108) is in the open position and drilling fluid can flow through the pulse flow path (54) from the pulse flow path inlet (56) to the pulse flow path outlet (58). When the distal end of the pulse valve moving member (108) is inserted into the pulse valve passage (104), the pulse valve moving member (108) is in the closed position and drilling fluid is prevented from flowing through the pulse flow path (54) from the pulse flow path inlet (56) to the pulse flow path outlet (58).

The phase of the actuator valve assembly (80) governs the movement of the pulse valve moving member (108) between the open position and the closed position. If the actuator valve moving member (86) completely occludes the actuator valve passage (84), then drilling fluid cannot flow from the actuator flow path (48) into the actuator chamber (49). Accordingly, the drilling fluid in the actuator chamber (49) evacuates through the pulse valve moving member passage (110), through the pulse valve aperture (104) and through the pulse flow path outlet (58) and into the region of low drilling fluid pressure distal to the apparatus (10). This decreases the drilling fluid pressure in the actuator chamber (49) that acts downwardly on the proximal end of the pulse valve moving member (108). Accordingly, the pulse valve moving member (108) moves upwardly against the biasing effect of the spring (112), and into the open position.

If the actuator valve moving member (86) does not occlude the actuator valve passage (84), then drilling fluid is able to flow from in the actuator flow path (48) into the actuator chamber (49). This increases the drilling fluid pressure in the actuator chamber (49) that acts on the proximal end of the pulse valve moving member (108).

Accordingly, the pulse valve moving member (108) moves downwardly, and into the closed position.

Third Exemplary Embodiment

Figure 6:
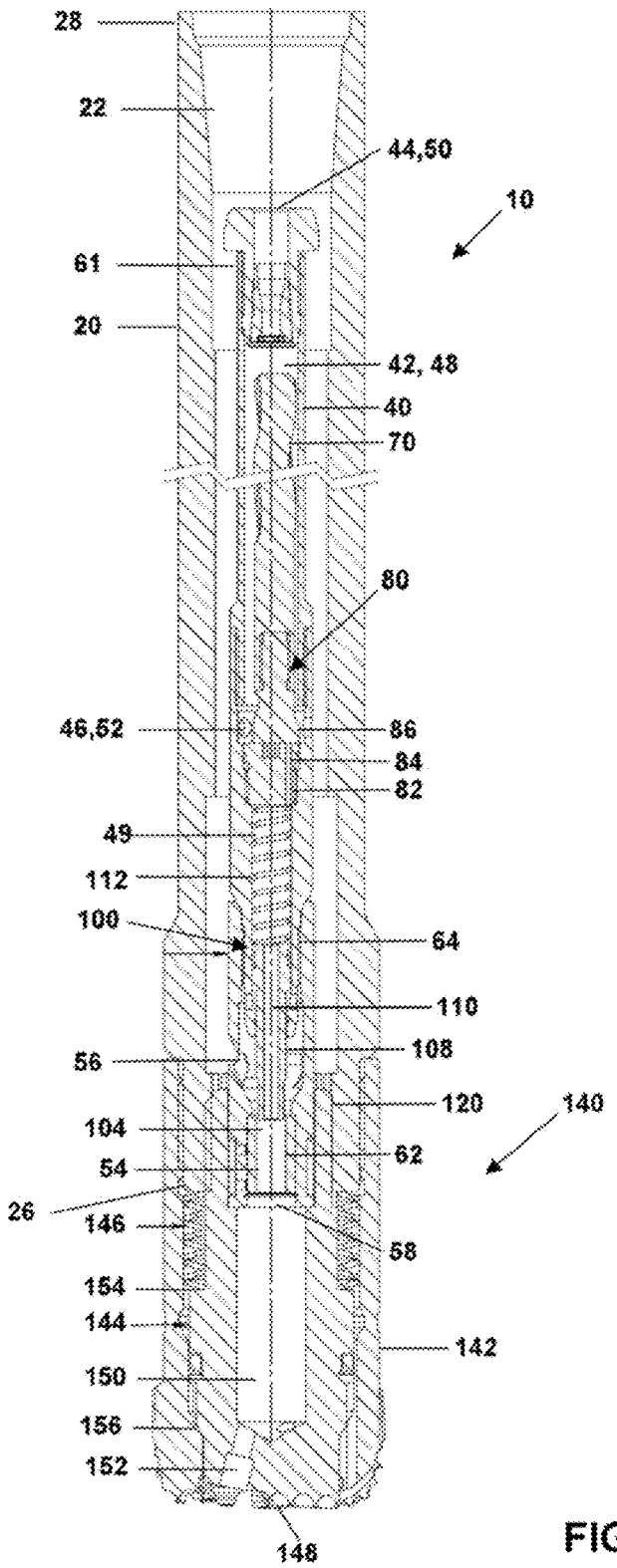
FIG. 6 is a longitudinal cross-sectional view of a third embodiment of the apparatus of the present invention comprising a drill bit assembly, with the pulse valve moving member between the open position and the closed position.

FIG. 6 shows another exemplary embodiment of the apparatus (10) of the present invention. In FIG. 6, parts that correspond to parts in FIG. 3 are assigned the same reference numerals. The differences between the apparatus (10) of FIG. 6 and that of FIG. 3 are described below.

In this exemplary embodiment, the housing defines a neck (61) that can be engaged by a downhole tool for retrieving the housing (40) and its contents from the downhole tubular (20).

The apparatus (10) further comprises a drill bit assembly (140) that extends from the distal end of the housing (40). The drill bit assembly (140) comprises a tubular outer drill bit body (142), an inner bit body (144), and a drill bit spring (146). The outer drill bit body (142) is coupled to the drill string tubular (20). In this exemplary embodiment, the drill bit body (142) is coupled directly to the drill string tubular (20) by a threaded connection formed on the distal end of the tubular (20) and the proximal end of the outer drill bit body (142).

The inner drill bit body (144) comprises a cutting element (148) for cutting a wellbore. In this exemplary embodiment, the cutting element (148) comprises a plurality of teeth-like cutting elements. The inner drill bit body (144) is disposed within the outer drill bit body (142) and is slidable relative to the outer drill bit body (142) for moving between a proximal retracted position, and a distal extended position as shown in FIG. 6. (It will be understood that the drill bit spring (146) is elongated in the distal extended position as compared with the proximal retracted position). The inner drill bit body (144) defines a drill bit bore (150) for drilling fluid communication from the pulse flow path outlet (58) to the wellbore. In this exemplary embodiment, the drill bit bore (150) includes a central, substantially cylindrical aperture formed in the inner drill bit body (144) that is in drilling fluid communication with the wellbore via a plurality of nozzles (152) that help to flush wellbore cuttings. In this exemplary embodiment, the inner drill bit body (144) further acts as the retainer (120) for fixing the housing (40) within the drill string bore (22).

In this exemplary embodiment, the drill bit spring (146) biases the inner drill bit body (144) towards the extended position. In this exemplary embodiment, the proximal end of the drill bit spring (146) bears upwardly against the distal end of the drill string tubular (20), while the distal end of the drill bit spring (146) bears downwardly against an external shoulder (154) of the inner drill string. In this exemplary embodiment, the proximal retracted position of the inner drill bit body (144) is limited by engagement with the distal end (26) of the drill string tubular (20) via the drill bit spring (146). In this exemplary embodiment, the distal extended position of the inner drill bit body (144) is limited by engagement with an internal shoulder (156) of the outer drill bit body (142).

The principle of operation of this exemplary embodiment of the apparatus (10) shown in FIG. 6 is similar to that of the exemplary embodiment of the apparatus (10) shown in FIG. 3. In use, the cutting element (148) of the inner drill bit body (144) is in contact with the cutting face of the wellbore. The pressure pulses in the drilling fluid emitted through the pulse flow path outlet (58) results in oscillatory motion of the inner drill bit body (144) relative to the outer drill bit body (142) between the retracted proximal position and the distal extended position. This oscillatory motion causes a percussive effect of the cutting element (148) on the cutting face of the wellbore.

Fourth Exemplary Embodiment

FIGS. 7-10 show another exemplary embodiment of the apparatus (10) of the present invention. In FIGS. 7-10, parts that correspond to parts in FIG. 1 are assigned the same reference numerals. The differences between the apparatus (10) of FIG. 7-10 and that of FIG. 1 are described below.

In this exemplary embodiment, the pulse valve assembly (100) is disposed at the proximal end of the housing (40). The pulse flow path outlet (58) is proximal to the aperture that defines the power flow path outlet (46) and the actuator flow path outlet (52) at the distal end of the housing (20). The pulse flow path outlet (58) discharges into the drill string bore (22) between the outer wall of the housing (40) and the inner wall of the drill string tubular (20), and ultimately through the retainer passage (124). The pulse valve moving member (108) is a shuttle that defines a pulse valve moving member passage (110) for fluid communication between the actuator flow path (48) and the actuator chamber (49). The actuator chamber (49) is distal to the actuator flow path inlet (50), but proximal to the actuator flow path outlet (52). As such, in this exemplary embodiment, the actuator chamber (49) is "in line" with the actuator flow path (48). An annular restrictor (130) integrally formed with the inner wall of the drill string tubular (20) engages the proximal end of the housing (40) to prevent the flow of drilling fluid between the restrictor (130) and the housing (40). The restrictor (130) is positioned to prevent drilling fluid communication between the pulse flow path inlet (56) and the pulse flow path outlet (58) via the drill string bore (22).

Figure 10:
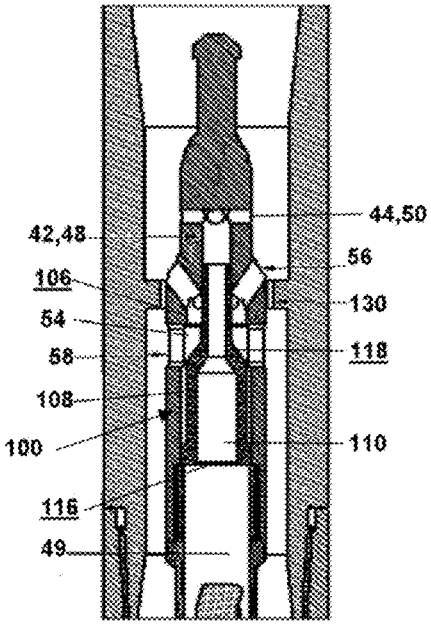
FIG. 10 is an enlarged view of region "A" of FIG. 9.
Figure 11:
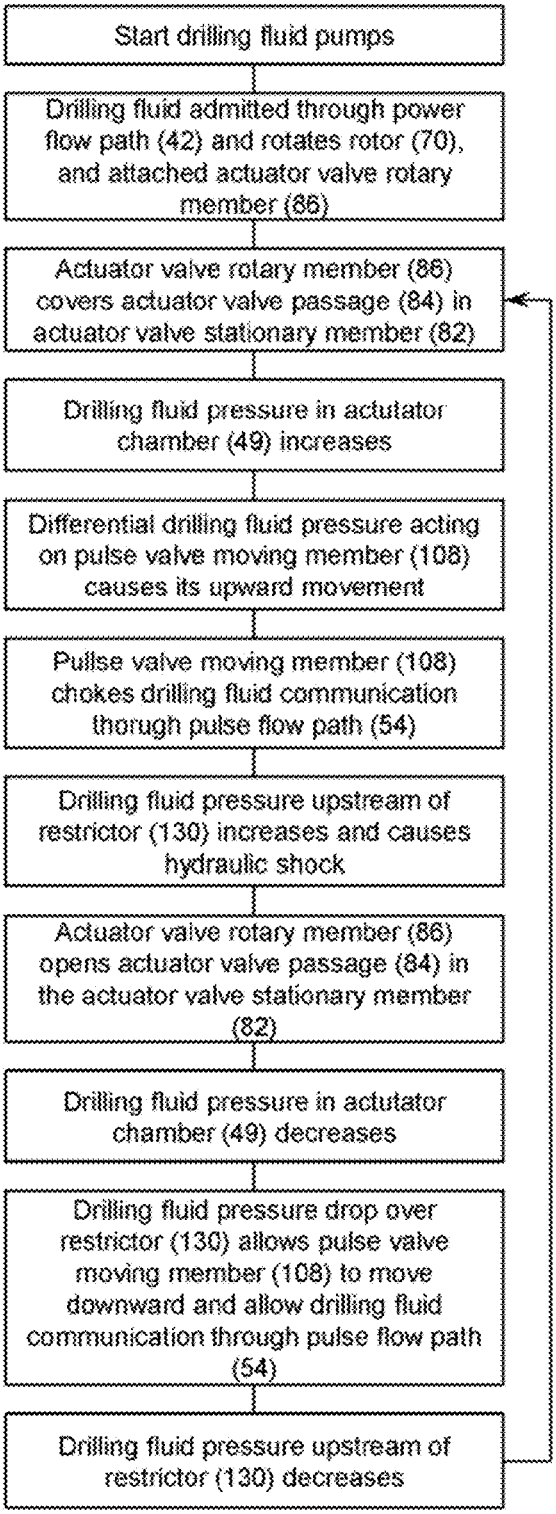
FIG. 11 is a flow chart showing one embodiment of the operation of the exemplary embodiment of the apparatus shown in FIGS. 7-10.

The use and operation of this exemplary embodiment of the apparatus (10) shown in FIGS. 7-10 are now described with reference to FIG. 11. The use and operation of the embodiment of the apparatus shown in FIG. 7-10 are similar to the use and operation of the exemplary embodiment of the apparatus (10) shown in FIG. 1, with the differences described below.

Figure 8:
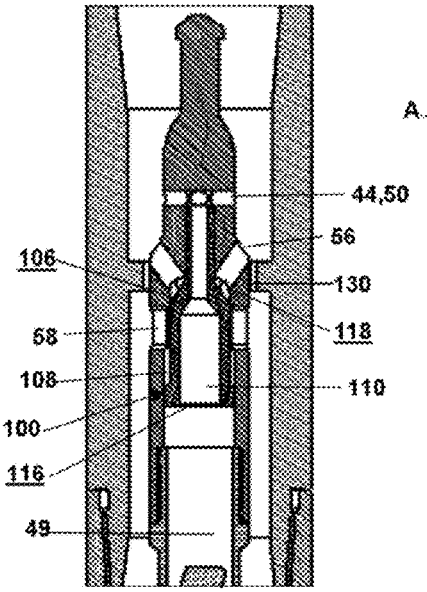
FIG. 8 is an enlarged view of region "A" of FIG. 7.
Figure 9:
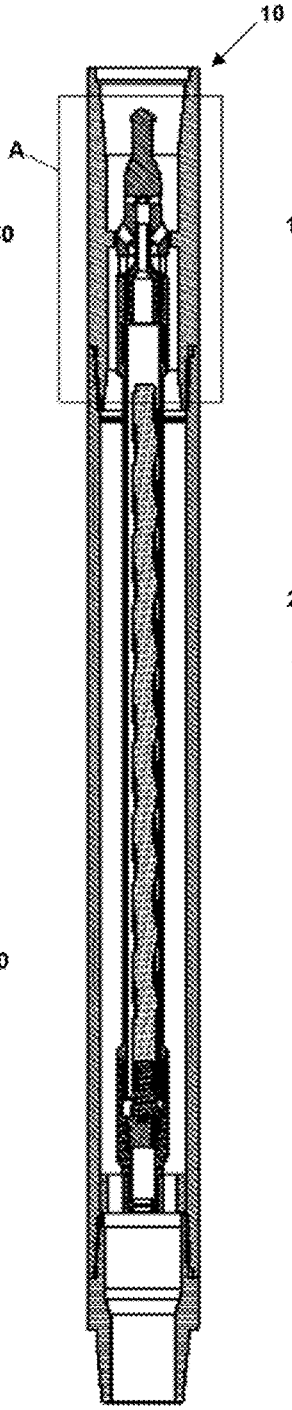
FIG. 9 is a longitudinal cross-sectional view of the embodiment of the apparatus shown in FIG. 7, with the pulse valve moving member in the open position.
Figure 7:
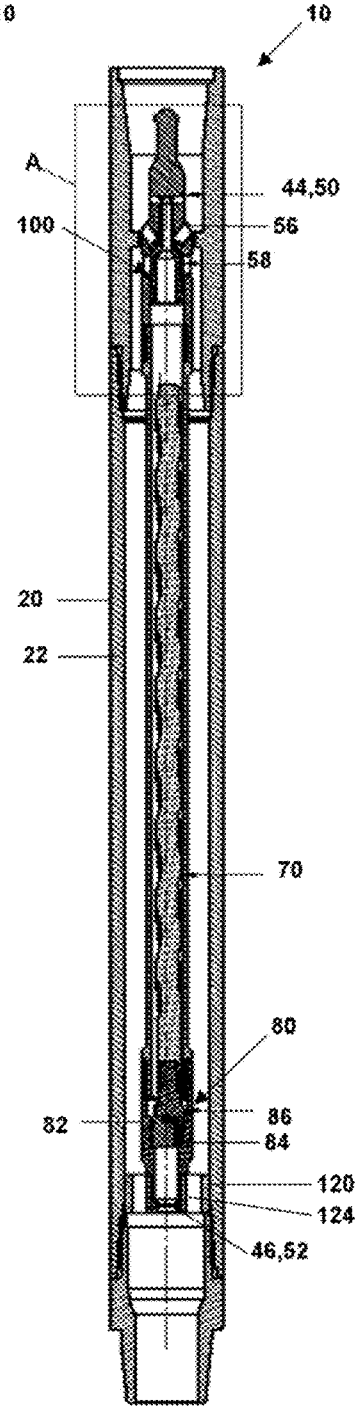
FIG. 7 is a longitudinal cross-sectional view of a fourth exemplary embodiment of the apparatus of the present invention, with the pulse valve moving member in the closed position.

When the pulse valve moving member (108) is in a closed position as shown in FIGS. 7 and 8, a proximal facing surface (118) of the pulse valve moving member (108) engages the seat (106) to prevent drilling fluid flowing through the pulse flow path outlet (58). This increases the drilling fluid pressure proximal of the restrictor (130) that acts downwardly on the proximal facing surface (118) of the pulse valve moving member (108) and urges the pulse valve moving member (108) toward the open position. Conversely, when the pulse valve moving member (108) is in the open position as shown in FIGS. 9 and 10, the proximal facing surface (118) of the pulse valve moving member (108) is disengaged from the seat (106). Accordingly, the drilling fluid flows into the housing (40) via the pulse flow path inlet (56), through the pulse flow path (54), out of the housing (40) via the pulse flow path outlet (58), in the drill string bore (22) between an internal wall of the drill string tubular (20) and the external wall of the housing (40), and ultimately through the retainer passage (124).

The phase of the actuator valve assembly (80) governs whether or not the pulse valve moving member (108) is able to move between the open position and the closed position. When the actuator valve moving member (86) completely occludes the actuator valve passage (84), the drilling fluid cannot flow out of the actuator chamber (49) through the actuator flow path outlet (52). This increases the drilling fluid pressure that acts upwardly on a distal facing surface (116) of the pulse valve moving member (108), which has a larger surface area than the proximal facing surface (118) of the pulse valve moving member (108). Conversely, when the actuator valve moving member (86) does not completely occlude the actuator valve passage (84), the drilling fluid can flow out of the actuator chamber (49) through actuator flow path outlet (52). This relieves the drilling fluid pressure in the actuator chamber (49). Accordingly, flow of drilling fluid out of the actuator chamber (49) varies the resultant force acting on the pulse valve moving member (108) due to the drilling fluid pressure in the actuator chamber (49) acting on the distal facing surface (116), and the drilling fluid pressure acting on the proximal facing surface (118), and the self-weight of the pulse valve moving member (108). The pulse valve moving member (108) moves upwardly to the open position when the resultant force acts upwards, and moves downwardly to the closed position when the resultant force acts downwards.

Fifth Exemplary Embodiment

Figure 12:
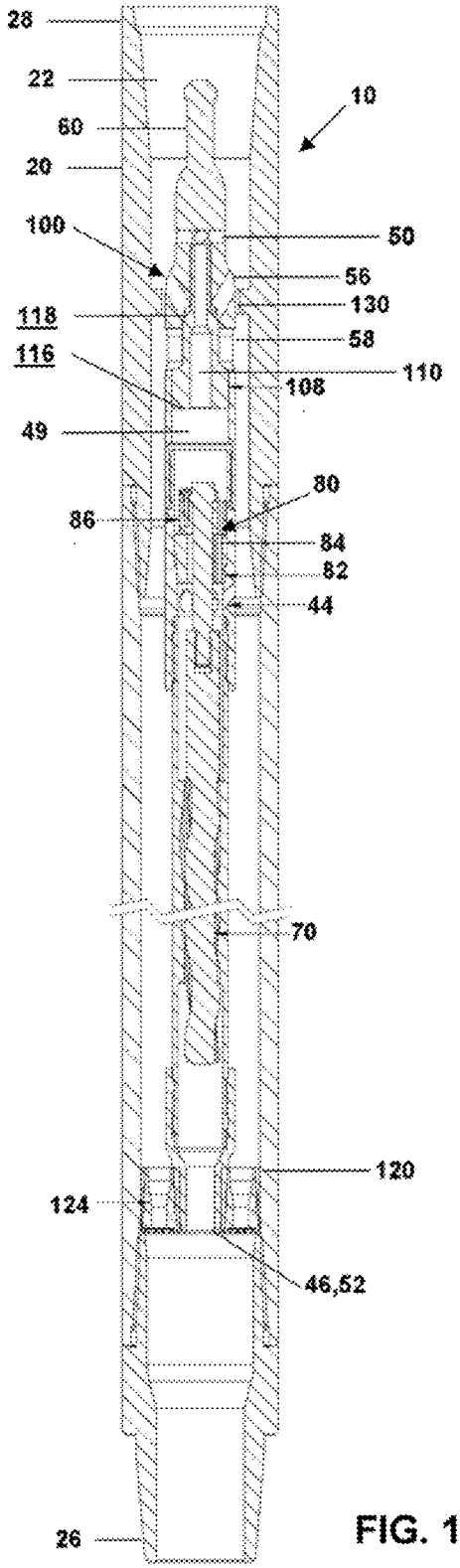
FIG. 12 is a longitudinal cross-sectional view of a fifth exemplary embodiment of the apparatus of the present invention, with the pulse valve moving member in the closed position.

FIG. 12 shows another exemplary embodiment of the apparatus (10) of the present invention. In FIG. 12, parts that correspond to parts in FIGS. 7-10 are assigned the same reference numerals. The differences between the apparatus (10) of FIG. 12 and that of FIGS. 7-10 are described below.

In this exemplary embodiment, the power flow path inlet (44) and the actuator flow path inlet (50) are formed by different apertures in the housing (40). The actuator valve assembly (80) and the actuator chamber (49) are disposed between the rotor (70) and the pulse valve assembly (100). The power flow path outlet (46), the actuator flow path outlet (52), and the retainer passage (124) are shaped to accelerate the drilling fluid as it flows towards the distal end of the drill string bore. The use and operation of this exemplary embodiment is in accordance with the principles described above for the apparatus shown in FIGS. 7-10.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

In this document, features described above or shown in the drawings in respect to one exemplary embodiment or exemplary use may be combined with and adapted for features of another exemplary embodiment or exemplary use. The exemplary embodiments and uses are intended to be illustrative of the present invention. Accordingly, various changes and modifications can be made to the exemplary embodiments and uses without departing from the scope of the invention as defined in the claims that follow.

The invention claimed is:

1. An apparatus for use with a downhole tubular defining a bore for conveying a drilling fluid between a proximal end and a distal end of the bore, the apparatus comprising:

(a) a housing for location in the bore and internally defining:
  (i) a power flow path in drilling fluid communication with the bore via a power flow path inlet and a power flow path outlet;
  (ii) an actuator flow path in drilling fluid communication with the bore via an actuator flow path inlet and an actuator flow path outlet;
  (iii) a pulse flow path in drilling fluid communication with the bore via a pulse flow path inlet and a pulse flow path outlet;

(b) a fluid actuated positive displacement motor comprising a rotor internal to the housing wherein, in use, rotation of the rotor relative to the housing is actuated by the drilling fluid flowing through the power flow path;

(c) an actuator valve assembly internal to the housing, wherein the actuator valve assembly and the housing collectively define an actuator chamber internal to the housing and in drilling fluid communication with the bore via the actuator flow path inlet, the actuator valve assembly comprising:
  (i) an actuator valve stationary member defining an actuator valve passage for drilling fluid communication from the actuator chamber to the bore via the actuator flow path outlet; and
  (ii) an actuator valve moving member wherein the rotor is in driving engagement with the actuator valve moving member to, in use, drive movement of the actuator valve moving member to vary an open area of the actuator valve passage between a minimum actuator valve open area greater than or equal to nil and a maximum actuator valve open area, and thereby vary drilling fluid pressure in the actuator chamber as drilling fluid flows through the actuator flow path from the actuator flow path inlet to the actuator flow path outlet;

(d) a pulse valve assembly comprising:
  (i) a pulse valve stationary member defining a pulse valve passage for drilling fluid communication from the pulse flow path inlet to the pulse flow path outlet; and
  (ii) a pulse valve moving member internal to the housing, wherein, in use, the pulse valve moving member moves in response to varying drilling fluid pressure in the actuator chamber to vary an open area of the pulse valve passage between a minimum pulse valve open area greater than or equal to nil and a maximum pulse valve open area, and thereby vary drilling fluid pressure at the pulse flow path outlet.

2. The apparatus of claim 1 wherein the housing defines a housing aperture that defines both the power flow path inlet and the actuator flow path inlet.

3. The apparatus of claim 1 wherein the housing defines a housing aperture that defines both the power flow path outlet and the actuator flow path outlet.

4. The apparatus of claim 1 wherein the power flow path and the actuator flow path are coextensive with each other.

5. The apparatus of claim 1 wherein the pulse valve assembly is proximal to the actuator valve assembly.

6. The apparatus of claim 1 wherein the housing is removably insertable in the bore.

7. The apparatus of claim 1 wherein the motor comprises a stator formed by an internal wall of the housing.

8. The apparatus of claim 1 wherein, in use, the rotor rotates the actuator valve moving member eccentrically relative to the actuator valve passage to vary the open area of the actuator valve passage.

9. The apparatus of claim 1 wherein the pulse valve stationary member is integral with the housing.

10. The apparatus of claim 1 wherein the pulse valve stationary member defines a pulse valve seat, and wherein the pulse valve moving member varies the open area of the pulse valve passage by moving to alternately engage with and disengage from the valve seat.

11. The apparatus of claim 1 wherein the pulse valve moving member varies the open area of the pulse valve passage by moving to alternately extend into and withdraw from the pulse valve passage.

12. The apparatus of claim 1 wherein the pulse valve moving member defines a pulse valve moving member passage for drilling fluid communication from the actuator chamber to the pulse flow path.

13. The apparatus of claim 1 wherein the pulse valve moving member defines a pulse valve moving member passage for drilling fluid communication from the actuator flow path inlet to the actuator chamber.

14. The apparatus of claim 1 wherein the pulse valve assembly further comprises a spring for biasing the pulse valve moving member towards a position in which the open area of the pulse valve passage is at either the minimum pulse valve open area or the maximum pulse valve open area.

15. The apparatus of claim 1 wherein the pulse valve passage is shaped to, in use, accelerate flow of drilling fluid in the pulse flow path and thereby generate a reduced pressure of drilling fluid to urge the pulse valve moving member towards a position in which the open area of the pulse valve passage is at either the minimum pulse valve open area or the maximum pulse valve open area.

16. The apparatus of claim 1 further comprising a retainer that engages the downhole tubular and the housing for limiting movement of the housing within the bore, the retainer defining a retainer passage for drilling fluid communication through the bore that bypasses the pulse flow path.

17. The apparatus of claim 1 further comprising a restrictor disposed in an annular space between the housing and an inner wall of the downhole tubular, wherein the restrictor is positioned to prevent drilling fluid communication via the bore between the pulse flow path inlet and the pulse flow path outlet.

18. The apparatus of claim 1 further comprising a drill bit assembly comprising:

(a) a drill bit body comprising:

(i) a first drill bit body portion for coupling to the downhole tubular;

(ii) a second drill bit body portion comprising a cutting element for cutting a wellbore, and wherein, in use, the second drill bit body portion moves relative to the second drill bit body portion between a proximal retracted position and a distal extended position, in response to varying fluid pressure at the pulse flow path outlet; and (b) a drill bit spring that biases the second drill bit body portion towards either the proximal retracted position or the distal extended position.

19. A method comprising the steps of:

(a) providing an apparatus in a bore of a downhole tubular, wherein the apparatus comprises:

(i) a housing that defines at least one flow path for drilling fluid in drilling fluid communication with the bore:

(ii) a fluid actuated positive displacement motor comprising a rotor internal to the housing that rotates relative to the housing in response to drilling fluid flowing through the at least one flow path;

(iii) an actuator valve assembly internal to the housing, wherein the actuator valve assembly and the housing collectively define an actuator chamber internal to the housing and in drilling fluid communication with the at least one flow path, wherein the actuator valve assembly comprises an actuator valve stationary member defining an actuator valve passage for drilling fluid communication from the actuator chamber to the at least one flow path, and an actuator valve moving member, and (iv) a pulse valve assembly comprising a pulse valve stationary member defining a pulse valve passage for drilling fluid communication from the at least one flow path to the bore, and a pulse valve moving member internal to the housing; and (b) flowing the drilling fluid through the at least one flow path to actuate rotation of the rotor, wherein the rotor is in driving engagement with the actuator valve moving member to drive movement of the actuator valve moving member to vary an open area of the actuator valve passage and thereby vary drilling fluid pressure in the actuator chamber, wherein varying drilling fluid pressure in the actuator chamber actuates the pulse valve moving member to move relative to the pulse valve stationary member, and thereby vary an open area of the pulse valve passage and effect a varying fluid pressure in the at least one flow path and the bore.

20. The method of claim 19 further comprising the step of providing a drill bit assembly comprising: a first drill bit body portion coupled to the downhole tubular, a second drill bit body portion comprising a cutting element for cutting a wellbore, the second drill bit body portion movable relative to the first drill bit body portion between a proximal retracted position and a distal extended position in response to varying fluid pressure in the at least one flow path; and a drill bit spring that biases the inner drill bit body towards either the proximal retracted position or the distal extended position.

* * * * *